US008197036B2

(12) United States Patent
Miura

(10) Patent No.: US 8,197,036 B2
(45) Date of Patent: Jun. 12, 2012

(54) LIQUID DISCHARGING HEAD WITH INCREASED STRENGTH AND IMAGE FORMING APPARATUS INCLUDING THE LIQUID DISCHARGING HEAD

(75) Inventor: Kunihiro Miura, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 576 days.

(21) Appl. No.: 12/400,330

(22) Filed: Mar. 9, 2009

(65) Prior Publication Data

US 2009/0231392 A1 Sep. 17, 2009

(30) Foreign Application Priority Data

Mar. 12, 2008 (JP) ..... 2008-062117

(51) Int. Cl.
*B41J 2/045* (2006.01)

(52) U.S. Cl. ..... 347/70; 347/71

(58) Field of Classification Search ..... 347/70, 347/71

See application file for complete search history.

(56) References Cited

U.S. PATENT DOCUMENTS

| | | | | |
|---|---|---|---|---|
| 6,382,778 | B1 * | 5/2002 | Iijima et al. | 347/65 |
| 6,648,455 | B2 * | 11/2003 | Takagi | 347/71 |
| 7,607,762 | B2 * | 10/2009 | Katsumura et al. | 347/68 |
| 2008/0303884 | A1 | 12/2008 | Miura | |

FOREIGN PATENT DOCUMENTS

| | | |
|---|---|---|
| JP | 3189575 | 5/2001 |
| JP | 2002-361862 | 12/2002 |
| JP | 2007-144886 | 6/2007 |

OTHER PUBLICATIONS

U.S. Appl. No. 11/786,725, filed Apr. 11, 2007.

* cited by examiner

*Primary Examiner* — Omar Rojas
(74) *Attorney, Agent, or Firm* — Cooper & Dunham LLP

(57) ABSTRACT

A liquid discharging head includes a plurality of nozzles for discharging liquid, a channel member formed of a metal plate, and a contacted member for being contacted by the channel member. The channel member includes a plurality of liquid chambers, each of which is connected to one of the plurality of nozzles, and a separation wall for separating adjacent liquid chambers from each other. The separation wall includes a center portion and a contact surface. The center portion is provided at a center of the separation wall in a long direction of the separation wall. The contact surface contacts the contacted member, and is tilted in a cross-section of at least the center portion of the separation wall taken in a short direction of the separation wall.

9 Claims, 9 Drawing Sheets

LIQUID DISCHARGING HEAD WITH INCREASED STRENGTH AND IMAGE FORMING APPARATUS INCLUDING THE LIQUID DISCHARGING HEAD

BACKGROUND

1. Technical Field

The present specification describes a liquid discharging head and an image forming apparatus, and more particularly, a liquid discharging head for discharging liquid and an image forming apparatus including the liquid discharging head.

2. Discussion of the Background

Image forming apparatuses, such as copiers, printers, facsimile machines, plotters, or multifunction printers having at least one of copying, printing, scanning, and facsimile functions, typically form an image on a recording medium (e.g., a sheet) by a liquid discharging method. Thus, for example, a liquid discharging head discharges liquid (e.g., an ink droplet) onto a conveyed sheet, and the liquid is then adhered to the sheet to form an image on the sheet.

Such liquid discharging head may include a piezoelectric actuator for generating pressure to compress ink contained in a pressing liquid chamber, so that ink droplets are discharged from a nozzle connected to the pressing liquid chamber onto the sheet.

Currently, there is market demand for an image forming apparatus capable of forming high-quality images at high speed. To accommodate such demand, the liquid discharging head may include more nozzles arranged in more densely packed formation to provide such high-quality images. A by-product of such an arrangement is that it causes a gap, that is, a separation wall, provided between the adjacent pressing liquid chambers to become narrower and consequently weaker. To provide image formation at the requisite high speed, a long liquid discharging head corresponding to a full-width of a sheet is used.

The pressing liquid chambers may be formed of a channel member, such as a silicon plate or a metal plate. When a silicon plate is used as the channel member, the separation walls provided in the silicon plate can provide the necessary strength even with relatively narrow separation walls. However, it may take a longer time period and increased costs to etch through-holes or concave portions serving as the pressing liquid chambers in the silicon plate. Moreover, use of silicon plate complicates manufacture of the long liquid discharging head described above.

On the other hand, when a metal plate, such as an SUS plate, is used as the channel member, the pressing liquid chambers can be processed in the metal plate easily at decreased costs. However, the separation walls may provide decreased strength.

Another problem is that the channel member is attached to a nozzle plate provided with nozzles and to a vibration plate serving as a wall surface of the pressing liquid chambers with an adhesive. However, the adhesive may not provide the necessary adhesion strength for the narrower separation walls provided in the channel member.

SUMMARY

This patent specification describes a novel liquid discharging head. One example of a novel liquid discharging head includes a plurality of nozzles for discharging liquid, a channel member formed of a metal plate, and a contacted member for being contacted by the channel member. The channel member includes a plurality of liquid chambers, each of which is connected to one of the plurality of nozzles, and a separation wall for separating adjacent liquid chambers from each other. The separation wall includes a center portion and a contact surface. The center portion is provided at a center of the separation wall in a long direction of the separation wall. The contact surface contacts the contacted member, and is tilted in a cross-section of at least the center portion of the separation wall taken in a short direction of the separation wall.

This patent specification further describes a novel liquid discharging head. One example of a novel liquid discharging head includes a plurality of nozzles for discharging liquid and a channel member formed of a metal member. The channel member includes a plurality of liquid chambers, each of which is connected to one of the plurality of nozzles, and a separation wall for separating adjacent liquid chambers from each other. The separation wall includes a center portion and two side surfaces. The center portion is provided at a center of the separation wall in a long direction of the separation wall. The two side surfaces are provided opposite each other to face the adjacent liquid chambers, respectively. The two side surfaces are tilted in an identical direction in a cross-section of at least the center portion of the separation wall taken in a short direction of the separation wall.

This patent specification further describes a novel image forming apparatus. One example of a novel image forming apparatus includes a liquid discharging head including a plurality of nozzles for discharging liquid, a channel member formed of a metal plate, and a contacted member for being contacted by the channel member. The channel member includes a plurality of liquid chambers, each of which is connected to one of the plurality of nozzles, and a separation wall for separating adjacent liquid chambers from each other. The separation wall includes a center portion and a contact surface. The center portion is provided at a center of the separation wall in a long direction of the separation wall. The contact surface contacts the contacted member, and is tilted in a cross-section of at least the center portion of the separation wall taken in a short direction of the separation wall.

BRIEF DESCRIPTION OF THE DRAWINGS

The aforementioned and other aspects, features and advantages would be better understood by reference to the following detailed description when considered in connection with the accompanying drawings, wherein.

DETAILED DESCRIPTION OF THE EXEMPLARY EMBODIMENTS

Figure 1:
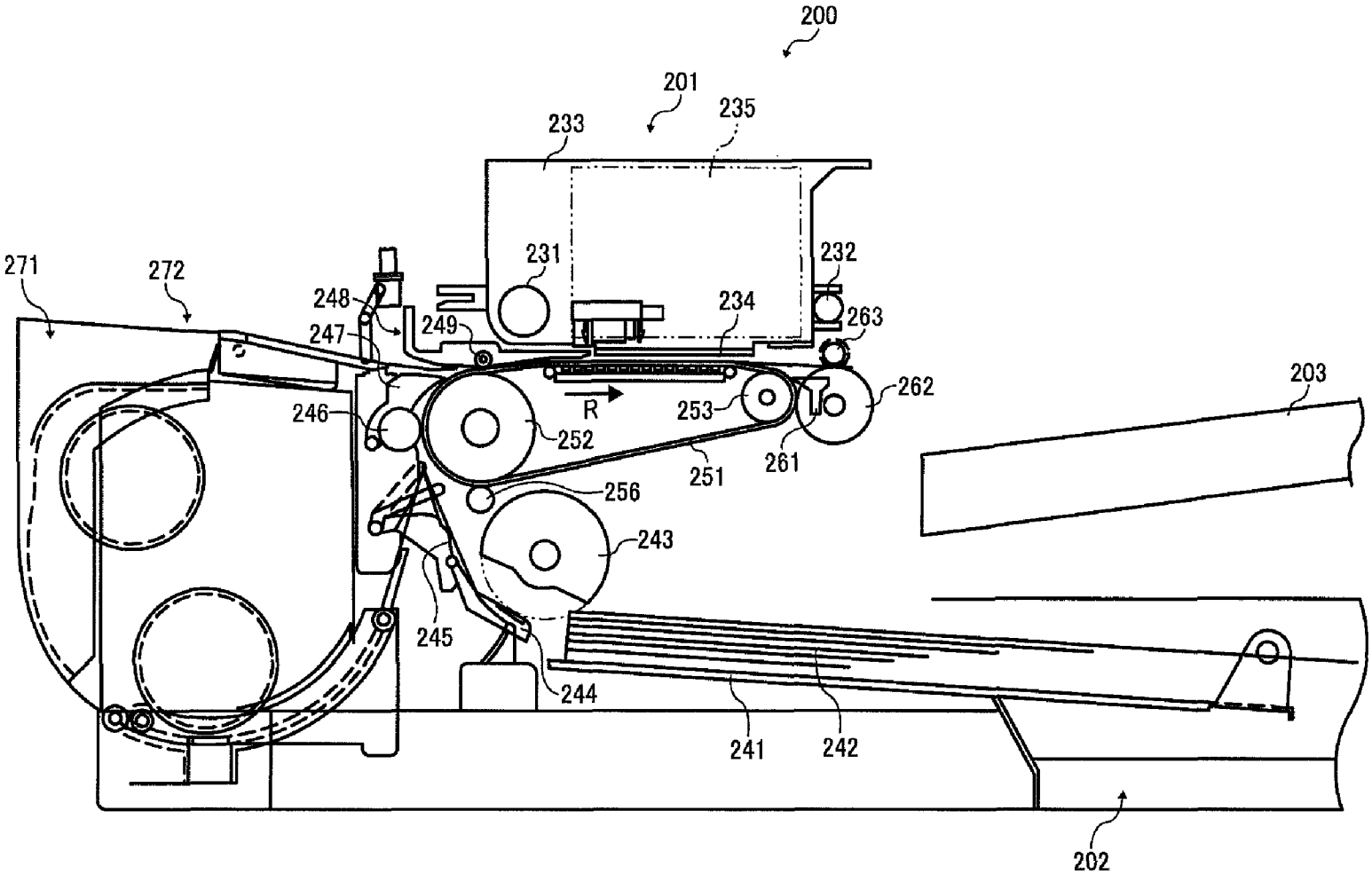
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
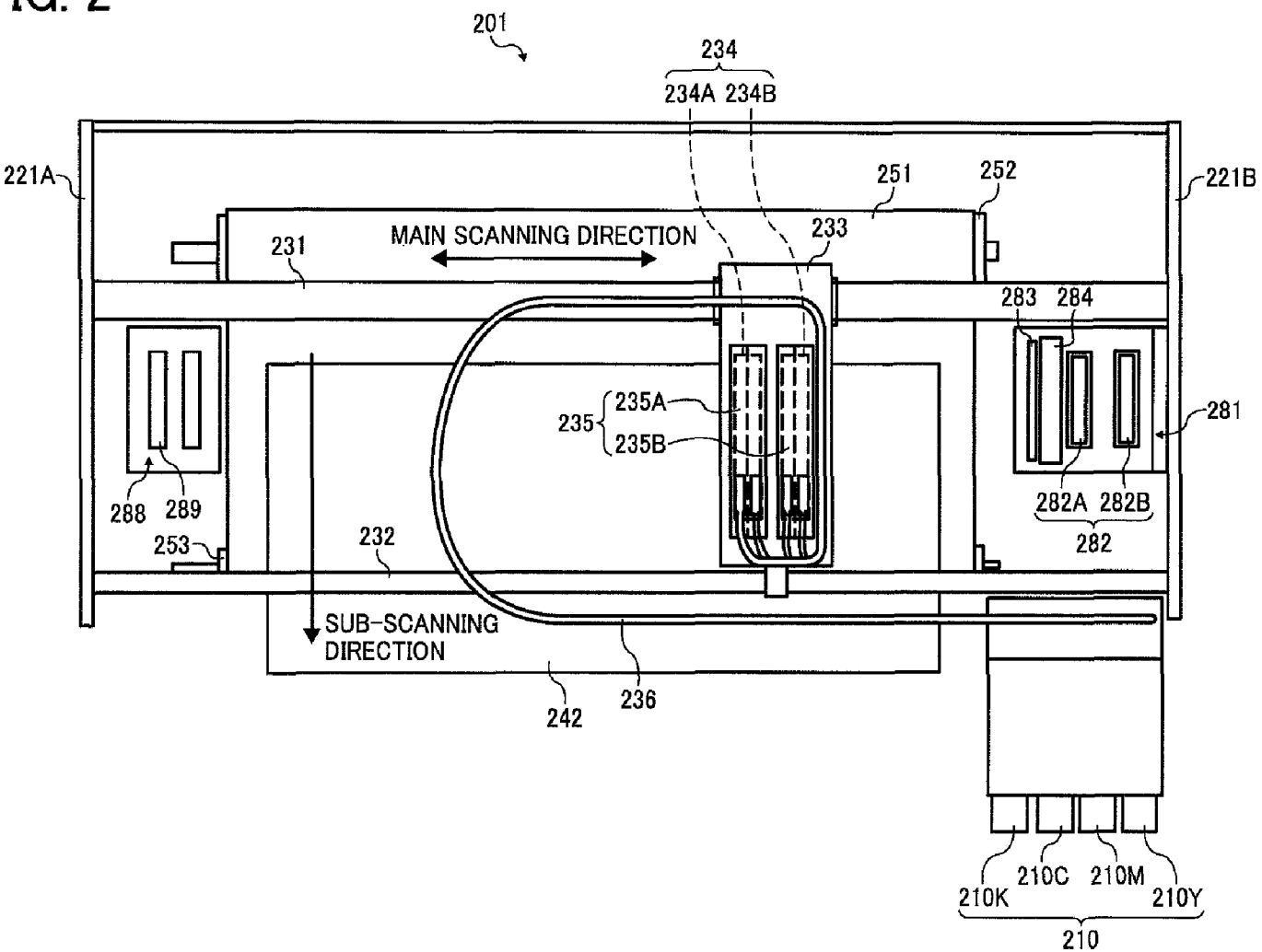
FIG. 2 is a plan view of an image forming device included in the image forming apparatus shown in FIG. 1.

Referring now to the drawings, wherein like reference numerals designate identical or corresponding parts throughout the several views, in particular to FIGS. 1 and 2, an image forming apparatus 200 according to an exemplary embodiment is explained.

FIG. 1 is a schematic view of the image forming apparatus 200. The image forming apparatus 200 includes an image forming device 201, a paper tray 202, a feed roller 243, a separation pad 244, a guide 245, a counter roller 246, a conveyance guide 247, a pressing member 248, a conveyance belt 251, a conveyance roller 252, a tension roller 253, a charging roller 256, a separation nail 261, output rollers 262 and 263, an output tray 203, a duplex unit 271, and a bypass tray 272.

The pressing member 248 includes a leading edge pressing roller 249. The image forming device 201 includes a main guide rod 231, a sub guide rod 232, a carriage 233, recording heads 234, and sub tanks 235. The paper tray 202 includes a sheet loading portion 241.

FIG. 2 is a plan view of the image forming device 201. The image forming device 201 includes a left side plate 221A, a right side plate 221B, ink cartridges 210, supply tubes 236, a maintenance-restoration mechanism 281, and an ink collection unit 288.

The recording heads 234 include recording heads 234A and 234B. The sub tanks 235 include sub tanks 235A and 235B. The ink cartridges 210 include ink cartridges 210K, 210C, 210M, and 210Y. The maintenance-restoration mechanism 281 includes caps 282, a wiper blade 283, and a preliminarily discharged droplet receiver 284. The caps 282 include caps 282A and 282B. The ink collection unit 288 includes openings 289.

The image forming apparatus 200 can be any of a copier, a printer, a facsimile machine, a plotter, and a multifunction printer including at least one of copying, printing, scanning, plotter, and facsimile functions. In this non-limiting exemplary embodiment, the image forming apparatus 200 functions as a serial-type printer for discharging liquid (e.g., ink or an ink droplet) to form an image on a recording medium (e.g., a recording sheet).

As illustrated in FIG. 2, the left side plate 221A and the right side plate 221B support the main guide rod 231 and the sub guide rod 232. The main guide rod 231 and the sub guide rod 232 serve as guide members for guiding the carriage 233. For example, the main guide rod 231 and the sub guide rod 232 support the carriage 233 in such a manner that the carriage 233 slides and moves on the main guide rod 231 and the sub guide rod 232 in a main scanning direction. A main scanning motor moves the carriage 233 in the main scanning direction via a timing belt.

The recording heads 234A and 234B are mounted on the carriage 233 and serve as liquid discharging heads for discharging yellow, cyan, magenta, and black ink droplets, respectively. In each of the recording heads 234A and 234B, two nozzle rows, each of which is formed of a plurality of nozzles, extend in a sub-scanning direction perpendicular to the main scanning direction, so that the plurality of nozzles discharges ink droplets downward.

Each of the recording heads 234A and 234B includes two nozzle rows. For example, in the recording head 234A, one nozzle row discharges black ink droplets and another nozzle row discharges cyan ink droplets. In the recording head 234B, one nozzle row discharges magenta ink droplets and another nozzle row discharges yellow ink droplets. According to this exemplary embodiment, the image forming apparatus 200 includes the two recording heads 234A and 234B for discharging ink droplets in the four colors. Alternatively, the image forming apparatus 200 may include four recording heads for discharging yellow, cyan, magenta, and black ink droplets, respectively. Yet alternatively, the image forming apparatus 200 may include a single recording head in which four nozzle rows, each of which includes a plurality of nozzles, discharge yellow, cyan, magenta, and black ink droplets, respectively.

The sub tanks 235A and 235B are mounted on the carriage 233 and correspond to the nozzle rows of the recording heads 234A and 234B to supply inks in corresponding colors to the recording heads 234A and 234B. The ink cartridges 210K, 210C, 210M, and 210Y contain black, cyan, magenta, and yellow inks, respectively. A supply unit supplies the black, cyan, magenta, and yellow inks from the ink cartridges 210K, 210C, 210M, and 210Y to the sub tanks 235A and 235B via the supply tubes 236, respectively.

As illustrated in FIG. 1, in the paper tray 202, the sheet loading portion 241 (e.g., a pressure plate) loads sheets 242. The feed roller 243, having a half-moon-like shape, separates a sheet 242 from other sheet 242 loaded on the sheet loading portion 241 and feeds the separated sheet 242 toward the guide 245. The separation pad 244 opposes the feed roller 243 and includes a material having an increased friction coefficient. The separation pad 244 is pressed against the feed roller 243. The feed roller 243 and the separation pad 244 serve as a sheet supplier.

The guide 245 guides the sheet 242 fed by the sheet supplier toward the counter roller 246. The counter roller 246 feeds the sheet 242 toward the conveyance guide 247. The conveyance guide 247 guides the sheet 242 toward the pressing member 248. The leading edge pressing roller 249 of the pressing member 248 presses the sheet 242 against the conveyance belt 251. The conveyance belt 251 serves as a conveyer for conveying the sheet 242 at a position opposing the recording heads 234 by electrostatically attracting the sheet 242. Thus, the sheet 242 fed by the sheet supplier is sent to a position under the recording heads 234.

The conveyance belt 251, having an endless belt-like shape, is looped over the conveyance roller 252 and the tension roller 253 to rotate in a direction of rotation R (e.g., a sub-scanning direction). The charging roller 256 serves as a charger for charging a surface of the conveyance belt 251. The charging roller 256 contacts a surface layer of the conveyance belt 251 and is driven and rotated by rotation of the conveyance belt 251. A sub-scanning motor drives and rotates the conveyance roller 252 via a timing belt so that the conveyance roller 252 rotates the conveyance belt 251 in the direction of rotation R.

The separation nail 261 and the output rollers 262 and 263 serve as an output device for discharging the sheet 242 bearing an image formed by the recording heads 234. For example, the separation nail 261 separates the sheet 242 from the conveyance belt 251. The output rollers 262 and 263 discharge the sheet 242 onto the output tray 203 provided under the output roller 262.

The duplex unit 271 is detachably attached to a rear portion of the image forming apparatus 200. The duplex unit 271 receives the sheet 242 fed by the conveyance belt 251 rotating backward, reverses the sheet 242, and feeds the sheet 242 toward a nip portion formed between the counter roller 246 and the conveyance belt 251. A top surface of the duplex unit 271 serves as the bypass tray 272.

As illustrated in FIG. 2, the maintenance-restoration mechanism 281 is disposed in a non-printing region provided in one end of the image forming device 201 in the main scanning direction in which the carriage 233 moves. The maintenance-restoration mechanism 281 serves as a maintenance-restoration device for maintaining and restoring a condition of the nozzles of the recording heads 234. In the maintenance-restoration mechanism 281, the caps 282A and 282B cap nozzle surfaces of the recording heads 234A and 234B, respectively. The wiper blade 283 wipes the nozzle surfaces of the recording heads 234. The preliminarily discharged droplet receiver 284 receives ink droplets discharged preliminarily and thereby not used for forming an image on the sheet 242 to discharge ink droplets having an increased viscosity.

The ink collection unit 288 (e.g., a preliminarily discharged droplet receiver) is disposed in another non-printing region provided in another end of the image forming device 201 in the main scanning direction in which the carriage 233 moves. The ink collection unit 288 serves as a liquid collection container for receiving ink droplets discharged preliminarily and thereby not used for forming an image on the sheet 242 to discharge ink droplets having an increased viscosity during an image forming operation and the like. In the ink collection unit 288, the openings 289 are arranged along the nozzle rows of the recording heads 234.

Referring to FIG. 1, the following describes an image forming operation performed in the image forming apparatus 200 having the above-described structure. The feed roller 243 and the separation pad 244 feed sheets 242 loaded on the paper tray 202 one by one upward toward the guide 245. The guide 245 guides the sheet 242 in a substantially vertical direction toward the nip portion formed between the counter roller 246 and the conveyance belt 251. The counter roller 246 and the conveyance belt 251 nip the sheet 242 and feed the sheet 242 toward the conveyance guide 247. The conveyance guide 247 guides a leading edge of the sheet 242 toward the leading edge pressing roller 249. The leading edge pressing roller 249 presses the sheet 242 against the conveyance belt 251 so that the conveyance belt 251 turns a sheet conveyance direction of the sheet 242 by about 90 degrees.

The charging roller 256 is applied with an alternating voltage in which positive output and negative output are alternately repeated. Accordingly, the conveyance belt 251 has an alternating charging voltage pattern. For example, the conveyance belt 251 is charged in such a manner that a positively charged band and a negatively charged band having a predetermined length are alternately provided in the sub-scanning direction in which the conveyance belt 251 rotates. When the sheet 242 is sent onto the conveyance belt 251 charged alternately with positive and negative voltages, the conveyance belt 251 attracts the sheet 242, and the rotating conveyance belt 251 conveys the sheet 242 in the sub-scanning direction.

While the carriage 233 moves, the recording heads 234 are driven according to an image signal. For example, the recording heads 234 discharge ink droplets onto the sheet 242 stopped on the conveyance belt 251 to form an image of one line. After the conveyance belt 251 conveys the sheet 242 for a predetermined amount, the recording heads 234 form an image of a next one line. When the recording heads 234 receive an image formation completion signal or a signal indicating that a trailing edge of the sheet 242 reaches an image forming region, the image forming operation is finished, and the sheet 242 is output onto the output tray 203.

Figure 3:
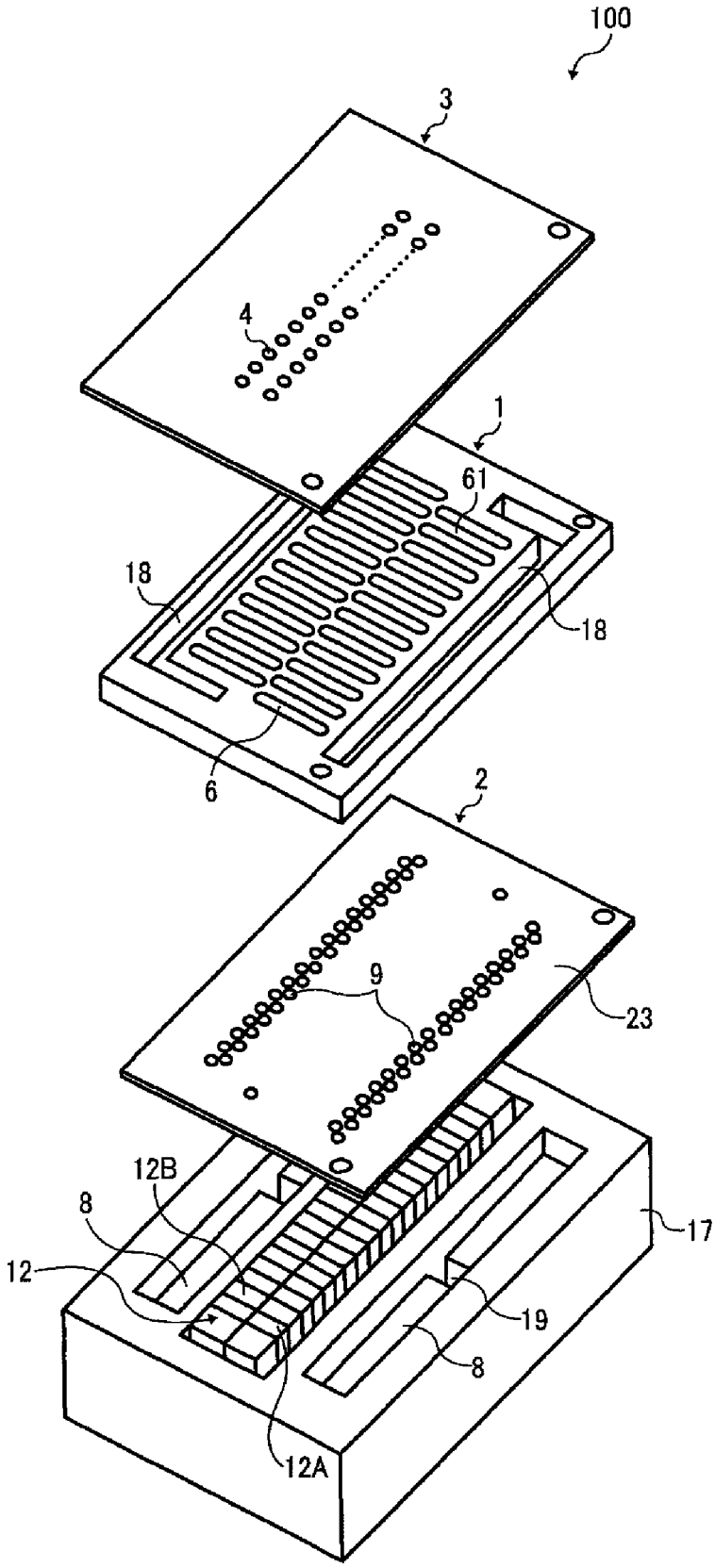
FIG. 3 is an exploded perspective view of a liquid discharging head included in the image forming device shown in FIG. 2.
Figure 4:
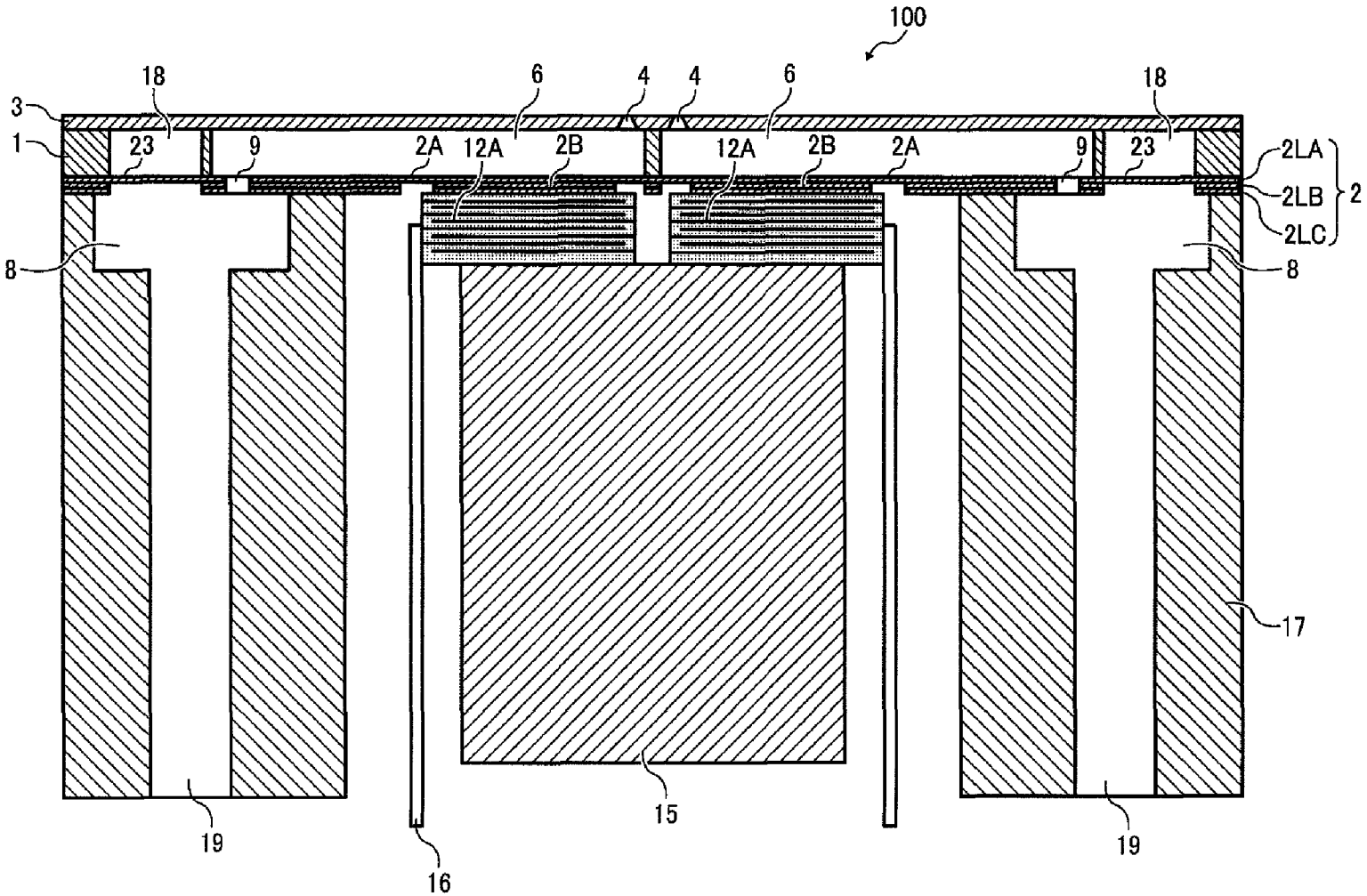
FIG. 4 is a sectional view of the liquid discharging head shown in FIG. 3 taken along a long direction of a pressing liquid chamber included in the liquid discharging head.
Figure 5:
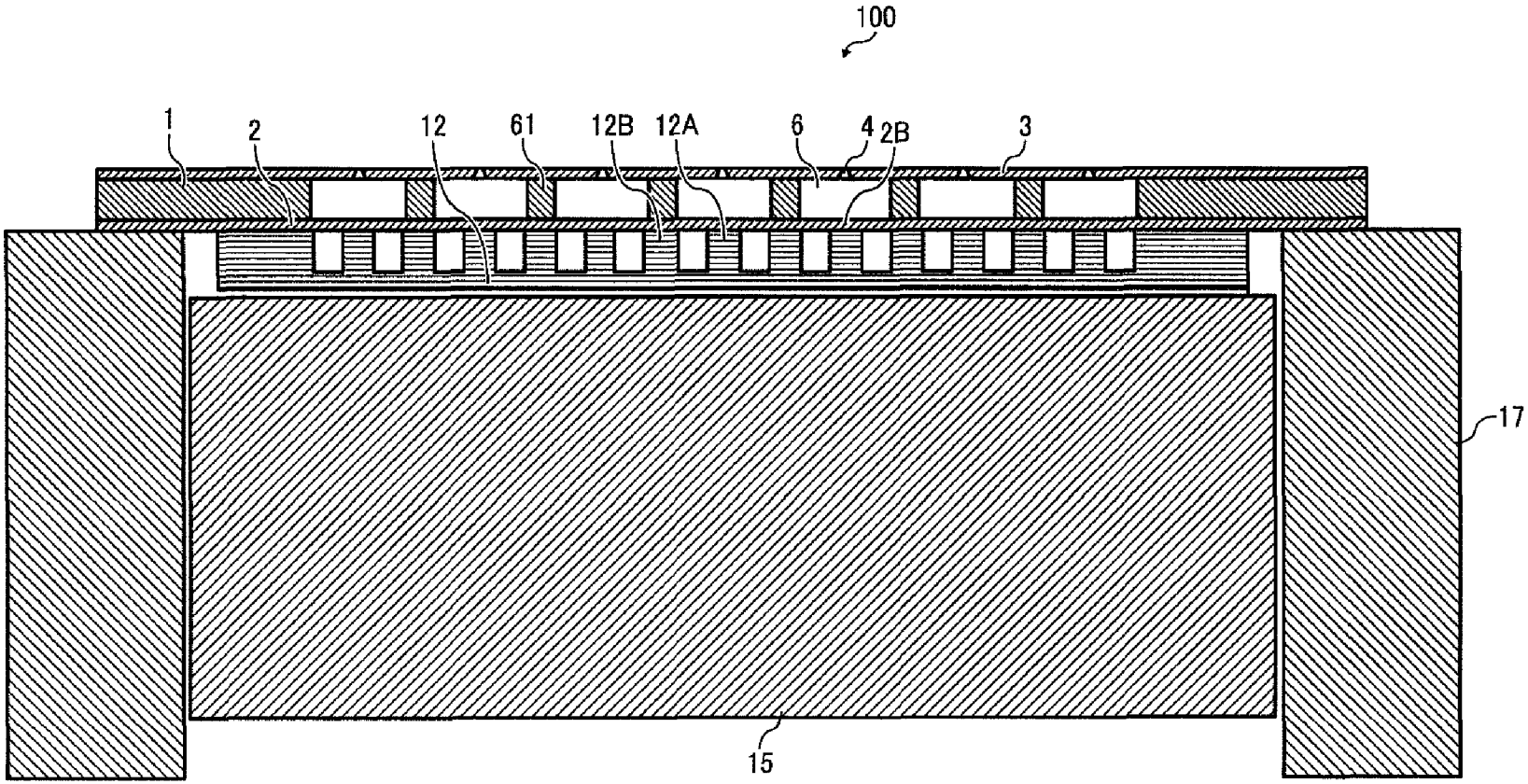
FIG. 5 is a sectional view of the liquid discharging head shown in FIG. 3 taken along a short direction of a pressing liquid chamber included in the liquid discharging head.

Referring to FIGS. 3 to 5, the following describes a liquid discharging head 100 being equivalent to the recording head 234A or 234B depicted in FIG. 2.

FIG. 3 is an exploded perspective view of the liquid discharging head 100. The liquid discharging head 100 includes a channel plate 1, a vibration plate 2, a nozzle plate 3, a piezoelectric element member 12, a frame 17, a shared liquid chamber 8, and an ink inlet 19.

The channel plate 1 includes a pressing liquid chamber 6, a separation wall 61, and a damper chamber 18. The vibration plate 2 includes an inlet 9 and a damper surface 23. The nozzle plate 3 includes a nozzle 4. The piezoelectric element member 12 includes a driving piezoelectric element column 12A and a non-driving piezoelectric element column 12B.

FIG. 4 is a sectional view of the liquid discharging head 100 taken along a long direction of the pressing liquid chamber 6, that is, a direction perpendicular to a nozzle arrangement direction in which the nozzles 4 are arranged. The liquid discharging head 100 further includes a base 15 and an FPC cable 16. The vibration plate 2 includes a first layer 2LA, a second layer 2LB, a third layer 2LC, a diaphragm portion 2A, and a convex portion 2B.

FIG. 5 is a sectional view of the liquid discharging head 100 taken along a short direction of the pressing liquid chamber 6, that is, the nozzle arrangement direction in which the nozzles 4 are arranged.

As illustrated in FIG. 3, in the liquid discharging head 100, the channel plate 1 serves as a channel member. The vibration plate 2, serving as a contacted member, contacts a bottom surface of the channel plate 1. The nozzle plate 3, serving as a contacted member, contacts a top surface of the channel plate 1. The channel plate 1, the vibration plate 2, and the nozzle plate 3 form the pressing liquid chambers 6, fluid resistance portions, and the damper chambers 18. The pressing liquid chamber 6 (e.g., a pressure chamber, a pressing chamber, or a channel) serves as a liquid chamber, an individual channel, or an individual liquid chamber to which the nozzle 4 for discharging liquid droplets is connected. The fluid resistance portion also serves as a supply route for supplying liquid (e.g., ink) to the pressing liquid chamber 6.

The channel plate 1, using an SUS plate, includes openings (e.g., through-holes), such as the pressing liquid chambers 6, the fluid resistance portions, and the damper chambers 18. For example, the channel plate 1, the vibration plate 2, and the nozzle plate 3 form the pressing liquid chambers 6. The through-holes of the channel plate 1 form the pressing liquid chambers 6 and are defined as "the pressing liquid chambers of the channel plate".

As illustrated in FIG. 4, the vibration plate 2 is formed of a nickel plate having a three-layer structure manufactured by electroforming, for example. The first layer 2LA, the second layer 2LB, and the third layer 2LC are provided under the pressing liquid chambers 6 in this order in a top-to-bottom direction in FIG. 4 in such a manner that the second layer 2LB is formed on the third layer 2LC and the first layer 2LA is formed on the second layer 2LB. Alternatively, the vibration plate 2 may be a multilayer member formed of a resin member, such as polyimide, and a metal plate, such as an SUS substrate, or may be a resin member.

As illustrated in FIG. 3, a number of the nozzles 4 are formed in the nozzle plate 3 in correspondence to the pressing liquid chambers 6. The nozzle plate 3 is attached to the channel plate 1 with an adhesive. The nozzle plate 3 may include metal such as stainless steel and nickel, a resin such as a polyimide resin film, silicon, or combination of the above. An interior of the nozzle 4 has a horn-like shape. Alternatively, the interior of the nozzle 4 may have a substantially cylindrical shape or a substantially frustum shape. The nozzle 4 has a hole diameter at an ink droplet outlet ranging from about 15 μm to about 30 μm. Each of nozzle rows formed of the nozzles 4 has a nozzle pitch of about 150 dpi.

A water-repellent layer, on which water-repellent surface processing is performed, is provided on a nozzle surface (e.g., an ink droplet discharging surface) of the nozzle plate 3. The water-repellent layer includes a water-repellent film selected according to physical properties of recording liquid. For example, the water-repellent film is processed by PTFE (polytetrafluoroethylene)-Ni (nickel) eutectoid plating, electropainting with fluoroplastic, evaporation coating with evaporative fluoroplastic (e.g., pitch fluoride), baking after application of a solvent of a silicon resin and fluoroplastic, or the like. Thus, a shape and a flying property of a liquid droplet of recording liquid are stabilized to provide a high-quality image.

As illustrated in FIG. 4, the diaphragm portion 2A is formed of the first layer 2LA of the vibration plate 2 and corresponds to the pressing liquid chamber 6. The convex portion 2B is provided on a center of the diaphragm portion 2A and has a double-layer structure formed of the second layer 2LB and the third layer 2LC. The driving piezoelectric element column 12A, serving as a pressure generator or an actuator, contacts the convex portion 2B. As illustrated in FIG. 5, the non-driving piezoelectric element column 12B corresponds to the separation wall 61 of the pressing liquid chamber 6 and contacts a three-layer portion formed of the first layer 2LA, the second layer 2LB, and the third layer 2LC and including the convex portion 2B of the vibration plate 2 depicted in FIG. 4.

The piezoelectric element member 12 is divided into the driving piezoelectric element column 12A and the non-driving piezoelectric element column 12B to have a comb-tooth-like shape by slip processing with half-cut dicing. The non-driving piezoelectric element column 12B may function as a piezoelectric element, but serves as a mere column because a driving voltage is not applied to the non-driving piezoelectric element column 12B. The multilayer piezoelectric element member 12 contacts the base 15.

The piezoelectric element member 12 is formed of a piezoelectric layer and an internal electrode layer alternately layered. The piezoelectric layer has a thickness ranging from about 10 μm to about 50 μm per layer and includes lead zirconate titanate (PZT). The internal electrode layer has a thickness ranging from several micrometers per layer and includes argentum palladium (AgPd). An internal electrode is electrically connected to an individual electrode (e.g., an end face electrode or an external electrode) and a shared electrode alternately. A driving signal is supplied to the electrodes via the FPC cable 16 depicted in FIG. 4.

A displacement in a d33 direction or a d31 direction may be used as a piezoelectric direction of the piezoelectric element member 12 to compress ink in the pressing liquid chamber 6. According to this exemplary embodiment, the displacement in the d33 direction is used.

As illustrated in FIG. 3, the frame 17 contacts a circumference of the vibration plate 2 via an adhesive. The frame 17 is injection-molded with an epoxy resin or polyphenylene sulfide, for example.

The shared liquid chamber 8 is provided in the frame 17, and ink is supplied from the shared liquid chamber 8 to the pressing liquid chamber 6. For example, the ink is supplied from the shared liquid chamber 8 to the pressing liquid chamber 6 via the inlet 9 provided in the vibration plate 2. The ink inlet 19 is provided in the frame 17, and supplies ink to the shared liquid chamber 8 from an outside of the frame 17.

The first layer 2LA depicted in FIG. 4 of the vibration plate 2, which forms a wall surface of the pressing liquid chamber 6, forms the damper surface 23 forming a part of a wall surface of the shared liquid chamber 8. The damper chamber 18 is provided in the channel plate 1, and corresponds to the damper surface 23.

In the liquid discharging head 100 having the above-described structure, when a voltage lower than a reference voltage is applied to the driving piezoelectric element column 12A, the driving piezoelectric element column 12A shrinks to lower the vibration plate 2. Accordingly, the pressing liquid chamber 6 expands (e.g., a volume of the pressing liquid chamber 6 increases), and ink flows into the pressing liquid chamber 6. Thereafter, an increased voltage is applied to the driving piezoelectric element column 12A to elongate the driving piezoelectric element column 12A in a layered direction. Accordingly, the vibration plate 2 is deformed toward the nozzle 4 to shrink the pressing liquid chamber 6 (e.g., to decrease the volume of the pressing liquid chamber 6). Consequently, pressure is applied to ink in the pressing liquid chamber 6 to discharge (e.g., jet) an ink droplet from the nozzle 4.

When a voltage equivalent to the reference voltage is applied to the driving piezoelectric element column 12A, the vibration plate 2 returns to a default position. Accordingly, the pressing liquid chamber 6 expands and generates negative pressure to fill the pressing liquid chamber 6 with ink supplied from the shared liquid chamber 8. When vibration of a meniscus surface of the nozzle 4 is decreased and stabilized, the liquid discharging head 100 starts a next ink droplet discharging operation.

A driving method for driving the liquid discharging head 100 is not limited to the above-described method, that is, a pull-push method. For example, the liquid discharging head 100 may be driven by pulling and pushing caused by change in application of driving waveform.

Figure 6:
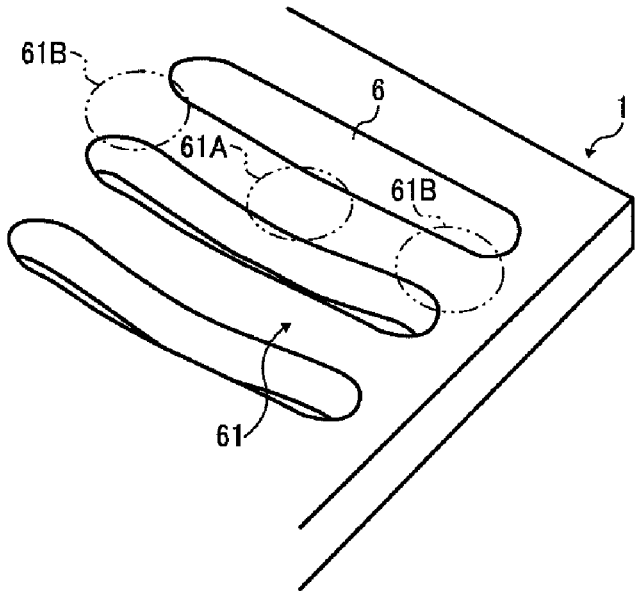
FIG. 6 is a partially enlarged perspective view of a channel plate included in the liquid discharging head shown in FIG. 3.
Figure 7:
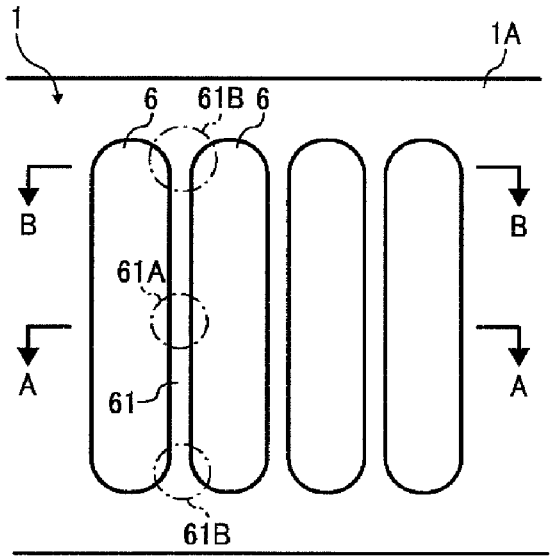
FIG. 7 is a partial plan view of the channel plate shown in FIG. 6.
Figure 8:
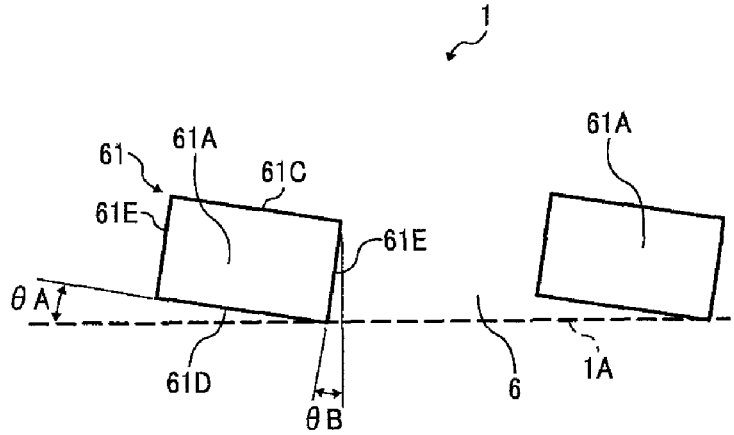
FIG. 8 is a partially sectional view of the channel plate shown in FIG. 7 taken on line A-A of FIG. 7.
Figure 9:
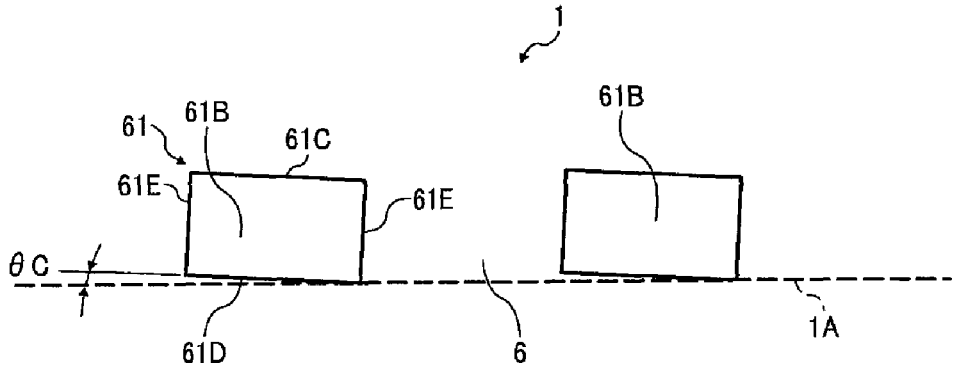
FIG. 9 is a partially sectional view of the channel plate shown in FIG. 7 taken on line B-B of FIG. 7.

Referring to FIGS. 6 to 9, the following describes the channel plate 1 serving as a channel member of the liquid discharging head 100. FIG. 6 is a partially enlarged perspective view of the channel plate 1. FIG. 7 is a partial plan view of the channel plate 1. FIG. 8 is a partially sectional view of the channel plate 1 taken on line A-A of FIG. 7. FIG. 9 is a partially sectional view of the channel plate 1 taken on line B-B of FIG. 7.

As illustrated in FIG. 6, the separation wall 61 includes a center portion 61A and end portions 61B.

As illustrated in FIG. 7, the channel plate 1 includes a contact surface 1A.

As illustrated in FIG. 8, the separation wall 61 further includes contact surfaces 61C and 61D and side surfaces 61E.

As illustrated in FIGS. 6 and 7, the channel plate 1 includes metal, such as SUS, and may be a multilayer member formed of at least two layers. In the channel plate 1, the separation wall 61 is provided between the adjacent pressing liquid chambers 6, and includes the center portion 61A provided at a center in a long direction of the separation wall 61 and the end portions 61B provided at both ends in the long direction of the separation wall 61.

As illustrated in FIG. 7, the contact surface 1A of the channel plate 1 serves as a surface of the channel plate 1 other than the separation wall 61. As illustrated in FIG. 8, the contact surfaces 61C and 61D of the separation wall 61 contact members attached to the channel plate 1 (e.g., the nozzle plate 3 and the vibration plate 2 depicted in FIG. 3). The two side surfaces 61E of the separation wall 61 serve as walls of the adjacent pressing liquid chambers 6, respectively. Specifically, one of the side surfaces 61E of the separation wall 61 faces one pressing liquid chamber 6 and another one of the side surfaces 61E of the separation wall 61 faces another pressing liquid chamber 6, that is, the adjacent pressing liquid chamber 6.

In a cross-section of the center portion 61A of the separation wall 61 taken in a short direction of the separation wall 61, the contact surfaces 61C and 61D of the separation wall 61 are tilted at an angle θA with respect to the contact surface 1A of the channel plate 1. Simultaneously, the side surfaces 61E of the separation wall 61 are tilted at an angle θB in an identical direction with respect to a plane perpendicular to the contact surface 1A of the channel plate 1.

By contrast, as illustrated in FIG. 9, in a cross-section of the end portion 61B of the separation wall 61 taken in the short direction of the separation wall 61, the contact surfaces 61C and 61D of the separation wall 61 are not tilted at an angle as large as the angle θA depicted in FIG. 8 with respect to the contact surface 1A of the channel plate 1, but are tilted at an angle θC which is smaller than the angle θA.

When the contact surfaces 61C and 61D and the side surfaces 61E of the separation wall 61 are tilted as illustrated in FIG. 8 in the cross-section of the center portion 61A of the separation wall 61 taken in the short direction of the separation wall 61, the center portion 61A of the separation wall 61 is twisted with respect to the both end portions 61B of the separation wall 61.

When at least the center portion 61A of the separation wall 61 of the channel plate 1 in the long direction of the separation wall 61 is twisted with respect to the both end portions 61B of the separation wall 61, as described above, the separation wall 61 can provide an improved strength.

Figure 10:
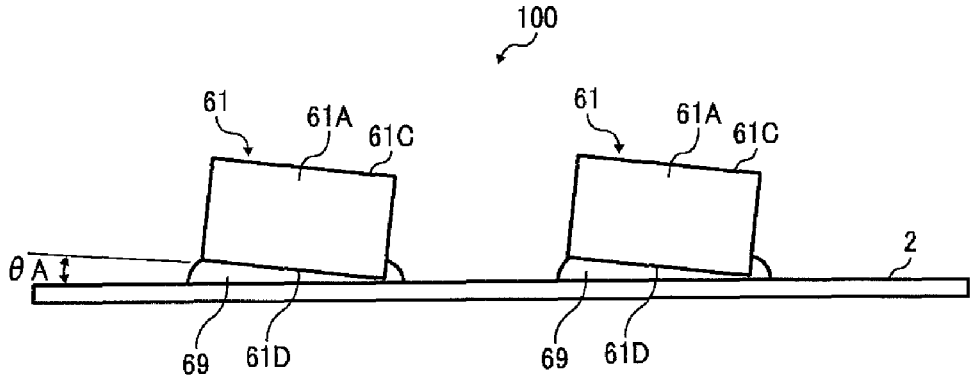
FIG. 10 is a partially enlarged sectional view of the liquid discharging head shown in FIG. 5 taken on line A-A of FIG. 7.

FIG. 10 is a partially enlarged sectional view of the liquid discharging head 100 taken on line A-A of FIG. 7. The liquid discharging head 100 further includes an adhesive 69.

When the contact surface 61D of the separation wall 61 is tilted at the angle θA with respect to a member attached to the channel plate 1 depicted in FIG. 6 (e.g., a contacted member for being contacted by the channel plate 1 serving as a channel member), that is, the vibration plate 2, for example, as illustrated in FIG. 10, the adhesive 69 is inserted into a gap between the contact surface 61D of the separation wall 61 of the channel plate 1 and the vibration plate 2. Accordingly, an overflow amount of the adhesive 69, that is, an amount of the adhesive 69 lying off the separation wall 61, can be reduced, providing stable adhesion quality. Similarly, the adhesive 69 is inserted into a gap between the contact surface 61C of the separation wall 61 of the channel plate 1 and the nozzle plate 3 depicted in FIG. 3 (e.g., a contacted member for being contacted by the channel plate 1 serving as a channel member).

By contrast, when the contact surface 61C or 61D of the separation wall 61 of the channel plate 1 is not tilted at the angle θA with respect to the nozzle plate 3 or the vibration plate 2, respectively, that is, when the contact surface 61C or 61D of the separation wall 61 of the channel plate 1 is parallel to a contact surface of the nozzle plate 3 or the vibration plate 2, which is attached to the channel plate 1, the overflow amount of the adhesive 69 may vary even when pressure applied to attach the nozzle plate 3 or the vibration plate 2 to the channel plate 1 is controlled sensitively. The variation in the overflow amount of the adhesive 69 when the vibration plate 2 is attached to the channel plate 1 may vary an ink droplet discharging property and may reduce yields of the liquid discharging head 100.

An experiment reveals that the angle θA ranges from about 2 degrees to about 15 degrees to provide improved adhesion quality, and preferably ranges from about 3 degrees to about 8 degrees.

Figure 11:
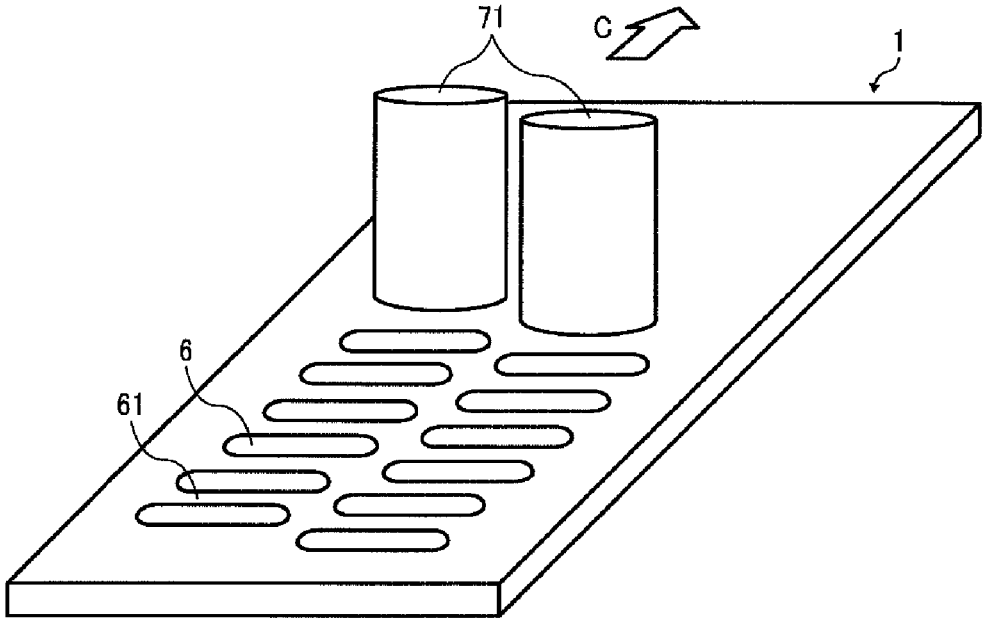
FIG. 11 is a perspective view of the channel plate shown in FIG. 6 for explaining a method for manufacturing the channel plate.
Figure 12:
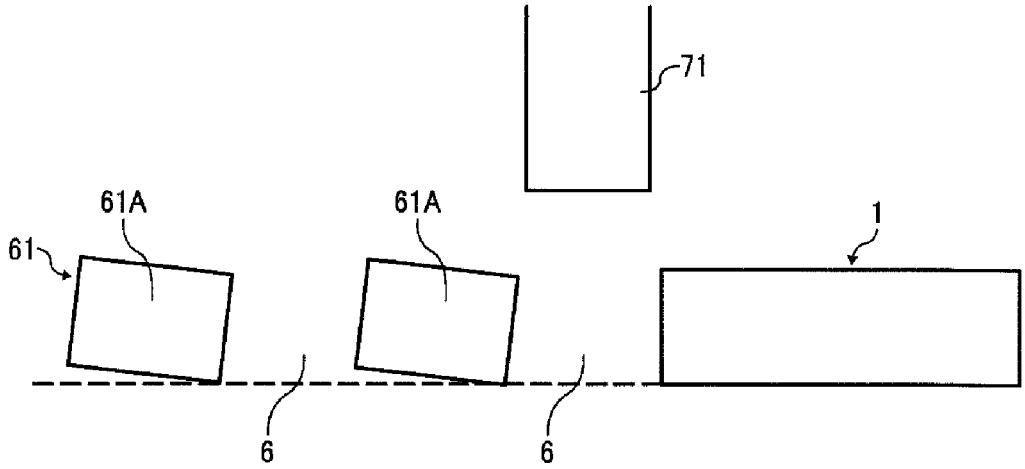
FIG. 12 is a partially sectional view of the channel plate shown in FIG. 11 taken along a short direction of a separation wall provided in the channel plate.
Figure 13A:
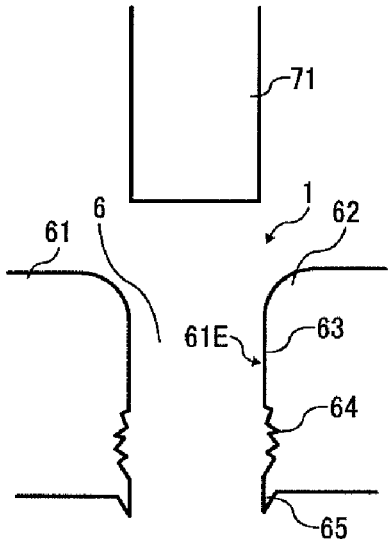
FIG. 13A is a partially enlarged sectional view of the separation wall shown in FIG. 12.
Figure 13B:
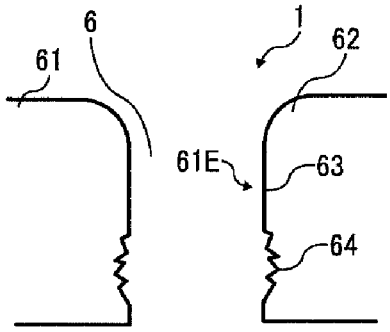
FIG. 13B is another partially enlarged sectional view of the separation wall shown in FIG. 12.

Referring to FIGS. 11, 12, 13A, and 13B, the following describes a method for manufacturing the channel plate 1. FIG. 11 is a perspective view of the channel plate 1. FIG. 12 is a partially sectional view of the channel plate 1 taken along the short direction of the separation wall 61. FIG. 13A is a partially enlarged sectional view of the separation wall 61. FIG. 13B is a partially enlarged sectional view of the separation wall 61.

As illustrated in FIG. 13A, the side surface 61E includes a round portion 62, a shear portion 63, a fracture portion 64, and a burr portion 65.

As illustrated in FIG. 11, the channel plate 1 is contacted by a jig 71. The channel plate 1 can be manufactured by punching. For example, as illustrated in FIG. 11, the jig 71 moving in a direction C punches holes in the channel plate 1 sequentially to form the pressing liquid chambers 6. Remaining bars form the separation walls 61. As an example condition of punching, sequence for slightly reducing a force applied by the jig 71 at a moment of punching can be used to twist the center portion 61A (depicted in FIG. 12) of the separation wall 61.

After the jig 71 punches a hole in the channel plate 1, the round portion 62 is formed on the side surface 61E of the separation wall 61, which serves as a wall surface of the pressing liquid chamber 6, at an entrance to the pressing liquid chamber 6, as illustrated in FIG. 13A. Further, the shear portion 63, the fracture portion 64, and the burr portion 65 are formed on the side surface 61E of the separation wall 61. It is preferable to mechanically remove the burr portion 65 as illustrated in FIG. 13B. However, the burr portion 65 may be buried in the adhesive 69 depicted in FIG. 10 according to a tilt degree of the side surface 61E and a size of the burr portion 65. When the burr portion 65 is buried in the adhesive 69, the burr portion 65 needs not be removed mechanically.

Figure 14:
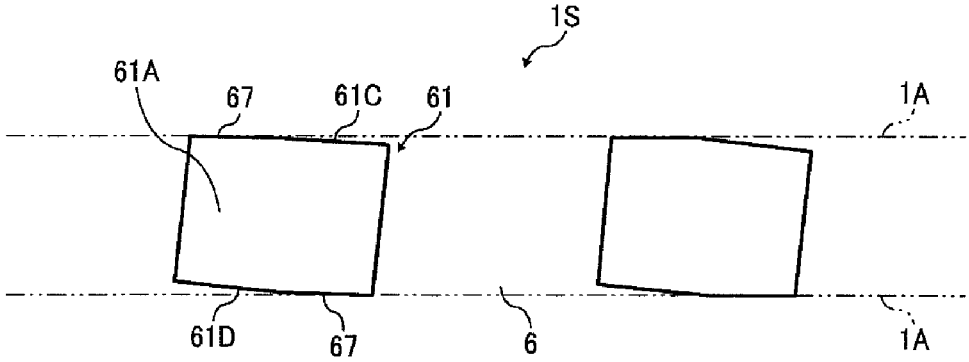
FIG. 14 is a partially enlarged sectional view of a channel plate according to another exemplary embodiment.

Referring to FIG. 14, the following describes a channel plate 1S according to another exemplary embodiment. FIG. 14 is a partially enlarged sectional view of the channel plate 1S. The channel plate 1S includes parallel portions 67. The other elements of the channel plate 1S are common to the channel plate 1 depicted in FIG. 8.

A part of each of the tilted contact surfaces 61C and 61D of the separation wall 61 forms the parallel portion 67. The parallel portions 67 of the separation wall 61 are processed in parallel to the contact surface 1A of the channel plate 1S for contacting the nozzle plate 3 (depicted in FIG. 3) provided above the channel plate 1S in FIG. 14 and in parallel to the contact surface 1A of the channel plate 1S for contacting the vibration plate 2 (depicted in FIG. 3) provided under the channel plate 1S in FIG. 14, when the burr portion 65 (depicted in FIG. 13A) is removed. Thus, the stable contact surfaces 61C and 61D are formed on the channel plate 1S to provide improved adhesion quality.

In a liquid discharging head (e.g., the liquid discharging head 100 depicted in FIG. 3) according to the above-described exemplary embodiments, a channel member (e.g., the channel plate 1), including a metal member, is provided with a plurality of liquid chambers (e.g., the pressing liquid chambers 6) to which a plurality of nozzles (e.g., the nozzles 4) for discharging liquid is connected, respectively. A separation wall (e.g., the separation wall 61) separates adjacent liquid chambers provided in the channel member from each other. The separation wall includes a center portion (e.g., the center portion 61A depicted in FIG. 6) provided at a center of the separation wall in a long direction of the separation wall. In a cross-section of at least the center portion of the separation wall taken in a short direction of the separation wall, a contact surface (e.g., the contact surfaces 61C and 61D depicted in FIG. 8) of the separation wall for contacting a contacted member for being contacted by the channel member is tilted. A side surface (e.g., the side surface 61E) of the separation wall serving as a wall surface of the liquid chamber is tilted. At least the center portion of the separation wall is twisted with respect to both end portions (e.g., the end portions 61B depicted in FIG. 6) provided at both ends of the separation wall in the long direction of the separation wall. Thus, the liquid discharging head can provide an improved strength of the separation wall and an improved adhesion strength of an adhesive (e.g., the adhesive 69 depicted in FIG. 10) for adhering the contact surface of the separation wall to the contacted member.

According to the above-described exemplary embodiments, an image forming apparatus (e.g., the image forming apparatus 200 depicted in FIG. 1) includes the liquid discharging head, providing stable discharging of liquid droplets and thereby forming a high-quality image.

In other words, as described above, the image forming apparatus includes a liquid discharging head (e.g., the liquid discharging head 100 depicted in FIG. 3) equivalent to the recording head 234A or 234B depicted in FIG. 2, providing improved reliability of the recording heads 234 and stable image formation.

According to the above-described exemplary embodiments, the liquid discharging head 100 depicted in FIG. 3 serves as a piezoelectric type liquid discharging head. Alternatively, the liquid discharging head 100 may be a thermal type liquid discharging head, an electrostatic type liquid discharging head, or other type liquid discharging head as long as the liquid discharging head 100 includes a channel member (e.g., the channel plate 1) provided with individual channels (e.g., the pressing liquid chambers 6).

Further, the liquid discharging head 100 may be installed in a serial-type image forming apparatus (e.g., the image forming apparatus 200 depicted in FIG. 1) or a line-type image forming apparatus.

According to the above-described exemplary embodiments, the liquid discharging head 100 is used in the image forming apparatus 200 which functions as a printer. Alternatively, the liquid discharging head 100 may be used in an image forming apparatus which functions as a multifunction printer having at least one of copying, printing, plotter, and facsimile functions, for example. Further, the liquid discharging head 100 may be used in an image forming apparatus using liquid other than ink, fixing liquid, and/or the like.

According to the above-described exemplary embodiments, the image forming apparatus includes an apparatus for forming an image by discharging or shooting liquid. A recording medium, on which the image forming apparatus forms an image, includes paper, strings, fiber, cloth, leather, metal, plastic, glass, wood, ceramics, and/or the like. An image formed by the image forming apparatus includes a character, a letter, graphics, a pattern, and/or the like. Liquid, with which the image forming apparatus forms an image, is not limited to ink but includes any fluid and any substance which can form an image, such as recording liquid, fixing processing liquid, a DNA sample, and registration and pattern materials.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2008-062117 filed on Mar. 12, 2008 in the Japan Patent Office, the entire contents of which are hereby incorporated herein by reference.

What is claimed is:

1. A liquid discharging head, comprising:
a channel member formed of a metal plate; and
a contacted member including an opposed surface contacted by the channel member,
the channel member comprising:
a plurality of liquid chambers; and
a separation wall to separate adjacent liquid chambers from each other,
the separation wall comprising:
a center portion provided at a center of the separation wall in a long direction of the separation wall;
a contact surface to contact the contacted member; and
another surface that is disposed opposite to the contact surface,
the contact surface and said another surface being tilted with respect to the opposed surface of the contacted member in a cross-section of at least the center portion of the separation wall taken in a short direction of the separation wall.

2. The liquid discharging head according to claim 1, wherein the channel member comprises a multilayer member formed of at least two layers.

3. The liquid discharging head according to claim 1, wherein the contacted member is attached to the channel member with an adhesive, and comprises at least one of a nozzle member in which a plurality of nozzles is provided and a vibration member to form a wall surface of the plurality of liquid chambers of the channel member.

4. A liquid discharging head, comprising:
a channel member formed of a metal member; and
a contacted member including an opposed surface contacted by the channel member,
the channel member comprising:
a plurality of liquid chambers; and
a separation wall to separate adjacent liquid chambers from each other,
the separation wall comprising:
a center portion provided at a center of the separation wall in a long direction of the separation wall; and two side surfaces provided opposite each other facing the adjacent liquid chambers, respectively, the two side surfaces being tilted in an identical direction in a cross-section of at least the center portion of the separation wall taken in a short direction of the separation wall, wherein the two side surfaces of the separation wall are tilted with respect to a plane perpendicular to the opposed surface of the contacted member.

5. The liquid discharging head according to claim 4, wherein the separation wall further comprises end portions provided at both ends of the separation wall in the long direction of the separation wall, the end portions being twisted with respect to the center portion of the separation wall.

6. The liquid discharging head according to claim 4, wherein the channel member comprises a multilayer member formed of at least two layers.

7. An image forming apparatus, comprising:

a liquid discharging head comprising:

a channel member formed of a metal plate; and a contacted member including an opposed surface contacted by the channel member, the channel member comprising:

a plurality of liquid chambers; and a separation wall to separate adjacent liquid chambers from each other, the separation wall comprising:

a center portion provided at a center of the separation wall in a long direction of the separation wall;

a contact surface to contact the contacted member; and another surface that is disposed opposite to the contact surface, the contact surface and said another surface being tilted with respect to the opposed surface of the contacted member in a cross-section of at least the center portion of the separation wall taken in a short direction of the separation wall.

8. The image forming apparatus according to claim 7, wherein the channel member comprises a multilayer member formed of at least two layers.

9. The image forming apparatus according to claim 7, wherein the contacted member is attached to the channel member with an adhesive, and comprises at least one of a nozzle member in which a plurality of nozzles is provided and a vibration member to form a wall surface of the plurality of liquid chambers of the channel member.

* * * * *